United States Patent [19]

Csathy et al.

[11] 4,153,012

[45] May 8, 1979

[54] WASTE HEAT WATERTUBE BOILER

[75] Inventors: Denis G. Csathy; Wendell L. Y. Hung, both of Minneapolis; Charles J. Pehoski, St. Paul, all of Minn.

[73] Assignee: Deltak Corporation, Minneapolis, Minn.

[21] Appl. No.: 862,024

[22] Filed: Dec. 19, 1977

[51] Int. Cl.[2] ..... F22B 1/18; F22B 9/04

[52] U.S. Cl. ..... 122/7 R; 122/114; 122/235 R

[58] Field of Search ..... 122/7 R, 7 B, 114, 115, 122/235 R

[56] References Cited

U.S. PATENT DOCUMENTS

| | | | |
|---|---|---|---|
| 934,679 | 9/1909 | Lea | 122/114 X |
| 1,812,513 | 6/1931 | Chrisman | 122/7 |
| 1,907,736 | 5/1933 | Cheetham et al. | 122/114 X |
| 1,973,968 | 9/1934 | Weigel et al. | 122/114 X |
| 2,048,308 | 7/1936 | Welter | 122/114 X |
| 3,976,033 | 8/1976 | Csathy et al. | 122/114 X |

*Primary Examiner*—Kenneth W. Sprague

*Attorney, Agent, or Firm*—Ira Milton Jones & Associates

[57] ABSTRACT

A vertical watertube boiler in which a bank of vertically oriented uniformly spaced watertubes, located in an upright cylindrical shell that has enlarged diameter upper and lower end portions, connect paired headers mounted on and protruding into diametrically opposite sides of the enlarged diameter end portions of the shell, the end portions of the tubes being bent laterally outward and joined to wall portions common to the headers and the gas pass formed by the shell; the headers associated with the upper enlarged diameter end portion of the shell being connected by risers with a steam drum and the headers at the lower enlarged end portion of the shell being connected with the steam drum by downcomers.

4 Claims, 3 Drawing Figures

WASTE HEAT WATERTUBE BOILER

This invention relates generally to steam generating boilers, and more especially to waste heat boilers used to cool the effluent gas emanating from the pyrolysis furnaces of ethylene plants. A boiler for that purpose is disclosed in the Csathy et al. U.S. Pat. No. 3,976,033.

While the boiler of U.S. Pat. No. 3,976,033, despite its being a firetube boiler, is well adapted to the service for which it was designed, the recent trend towards use of heavier hydrocarbons as feed stock in the operation of ethylene plants has introduced problems that militate against the use of firetube boilers, regardless of their design. Condensation of heavy hydrocarbons on the heat transfer surfaces of the boiler can only be avoided through the use of operating steam pressures that are higher than the upper limit for which firetube boilers are generally used.

Any attempt to adapt a firetube boiler to such high operating steam pressures, creates very serious structural problems. The shell becomes excessively thick, the tubesheets likewise must be increased in thickness to the point at which tubesheet failure becomes a very real probability, and the increased tube temperature produces thermal stresses between the tubes and the shell that significantly contribute to the probability of tubesheet failure.

In recognition of these limitations upon the use of firetube boilers, it is the purpose and object of this invention to provide a watertube boiler that is especially well adapted to the cooling of the effluent gas from the pyrolysis furnaces of ethylene plants that use the heavier hydrocarbons as feed stock.

Towards the attainment of that objective, this invention contemplates a watertube boiler that has no tubesheets and hence is not subject to possible tubesheet failure; in which the distributing headers and the collecting headers are basically outside the hot gas stream, so that any possible accumulation of solids in the lower distributing headers or in the steam pocket of the upper collecting headers will not cause overheating; and in which all of the water-tubes—which, of course, must be in the hot gas stream—have their upper and lower ends bent outwardly towards the headers with which they are connected, so that the tubes and especially their junctions with the headers are better able to withstand the forces of expansion and contraction than are the straight tubes of the earlier firetube versions of waste heat boilers.

As will be more fully described hereinafter, to attain the foregoing objectives the invention resides in the combination of means defining a vertically oriented gas pass through which the hot gaseous medium flows, the gas pass having a medial portion of substantially uniform cross section connecting opposite end portions of larger cross section and an axis that is common to its medial and opposite end portions; means providing an inlet for the gas pass opening into one of said end portions; means providing an outlet for the gas pass that exits from the other one of said end portions; means defining a pair of spaced apart headers joined to each of said end portions of the gas pass, each header having a wall portion that is common to it and to its respective end portion of the gas pass; and a bank of watertubes in the gas pass, all but the end portions of each tube in said bank being in said medial portion of the gas pass and substantially parallel with its axis, and the end portions of each of said tubes being in the larger cross section end portions of the gas pass and being bent laterally outwardly towards and having the extremities thereof joined to the adjacent one of said wall portions that are common to the headers and the gas pass, so that each tube communicates a header at one end of the gas pass with a header at the other end thereof.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of the embodiment of the invention constructed according to the best mode so far devised for the practical application of the principles thereof, and in which.

Figure 1:
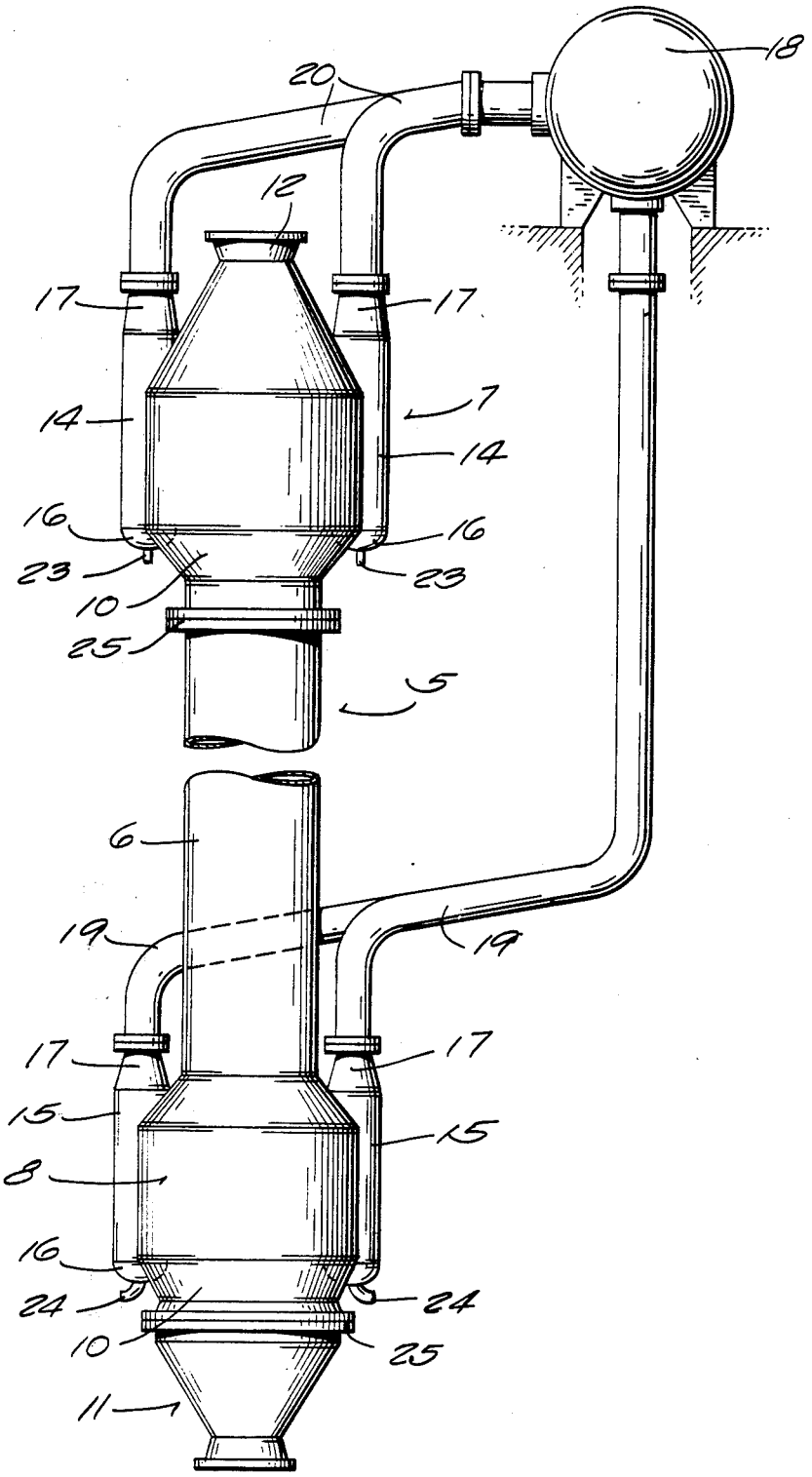
FIG. 1 is a side view of a vertical watertube boiler embodying this invention.
Figure 2:
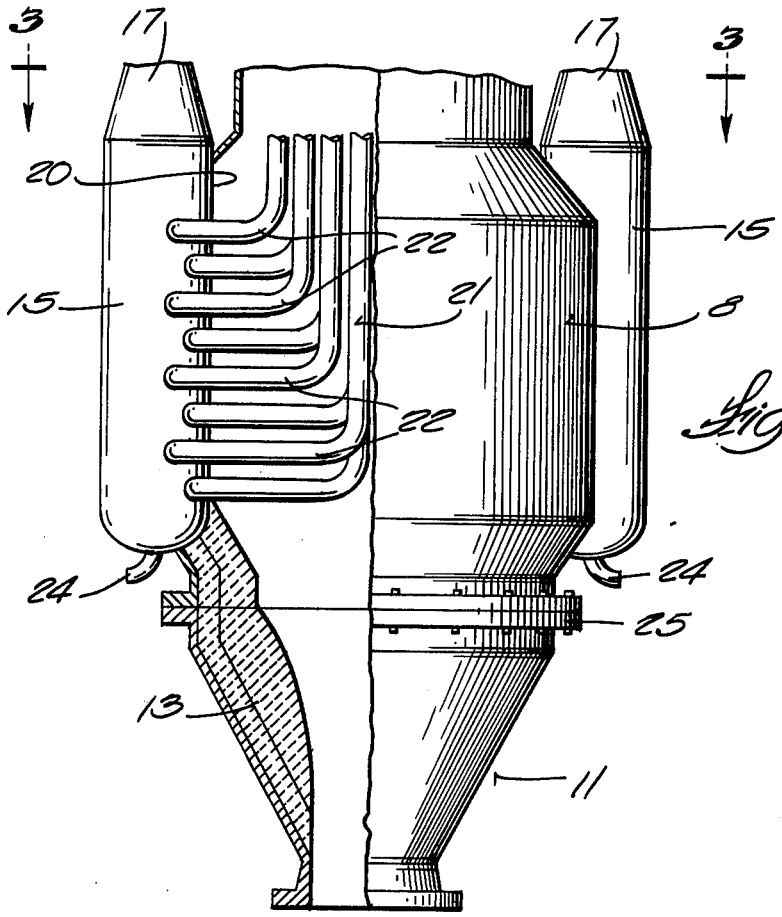
FIG. 2 is a view at an enlarged scale, of the lower end portion of the boiler with part thereof in section.

Referring to the accompanying drawings, the numeral 5 designates the shell of a vertically oriented watertube boiler embodying this invention. This shell is cylindrical and has a medial portion 6 of uniform cross section connecting upper and lower end portions 7 and 8, respectively, that are larger in cross section. For the major portion of their vertical dimension, these end portions are defined by uniform diameter cylindrical walls 9 that are connected with the uniform cross section medial portion 6 of the shell by conical walls 10.

The lower end portion 8 of the shell has an inlet section 11 connected thereto through which the hot effluent gas to be cooled enters the boiler to flow upwardly through the gas pass formed by the shell, to a gas outlet section 12. The outlet section 12 forms the top of the upper end portion 7 and is connectable with a stack, not shown. A heat insulating lining 13 covers the wall of the inlet section 11 and also the adjacent conical wall of the lower shell portion 8, to protect these surfaces from the hot incoming effluent gas.

The larger diameter end portions 7 and 8 of the shell have paired diametrically opposite collecting headers 14 and paired diametrically opposite distributing headers 15 respectively joined thereto. These headers are preferably vertically oriented cylinders with closed bottom walls 16 and truncated upper ends 17 by which the headers are connectable to ducts that lead to a steam drum 18. The ducts 19 that are joined to the lower-distributing headers provide the downcomers of the boiler and the ducts 20 that are joined to the upper collecting headers provide its risers.

Figure 3:
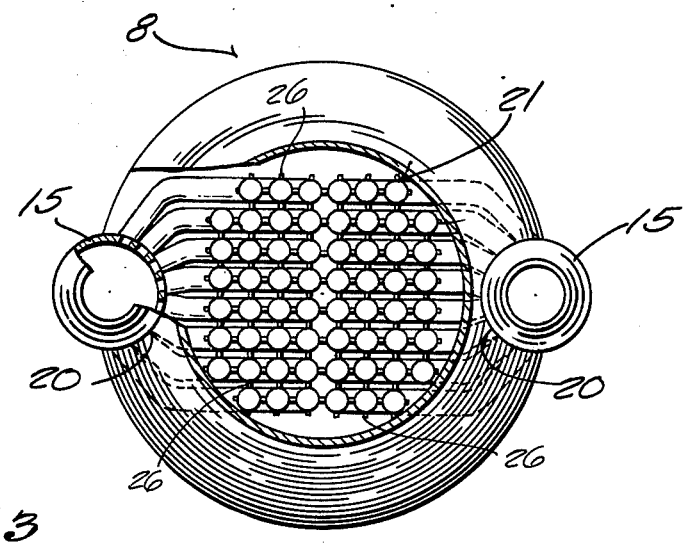
FIG. 3 is a cross sectional view through FIG. 2 on the plane of the line 3—3.

As particularly shown in FIG. 3, approximately one-half of each header projects into the interior of the larger diameter end portion of the shell to which it is joined. As a result a common wall 20 separates each header from its respective larger diameter end portion of the shell.

Within the gas pass defined by the shell is a bank of watertubes 21, all of which are parallel with the central vertical axis of the gas pass. The end portions 22 of each of these tubes are located in one or the other of the larger cross section end portions of the gas pass and are bent laterally outward to have their extremities joined to an adjacent one of the common walls 20. Each tube thus communicates one of the collecting headers with one of the distributing headers; and as also shown in FIG. 3, the laterally directed end portions 22 of the one-half of the tubes face towards and are joined to the headers at one side of the shell and those of the other half base towards and are joined to the headers at the diametrically opposite side of the shell.

All portions of all of the tubes are thus swept by the gas flowing upwardly through the gas pass; and by virtue of the way the headers are joined to the shell and the tubes are connected with the headers, none of the disruptive stresses that attend boilers that have tube sheets and straight tubes joined thereto are encountered in the boiler of this invention, even though the operating steam pressure is quite high. The bent formation of the tubes is especially significant in this connection; and to further accommodate inevitable expansion and contraction, the shell is provided with an expansion joint 25 between its enlarged end portions.

Each of the collecting headers 7 is equipped with a valved drain 24 at its bottom, and similarly at the bottom of each distributing header 8 there is a valved blowoff 24.

In operation, as will be readily apparent from the drawings and the preceding description the hot effluent gas entering the inlet 12 and flowing upwardly through the vertical gas pass on its way to the stack, is cooled by indirect heat transfer with the water circulating through the tubes 21.

Being a watertube boiler its tubes can take considerably higher internal than external pressure. For example, according to the rules of the A.S.M.E. Boiler and Pressure Vessel Code, a 2" O.D. carbon steel boiler tube with 0.120" minimum wall thickness (operating at below 700° F.) can be used for a maximum 1,340 psig internal pressure, but only a maximum of 390 psig external pressure.

Heat transfer conditions are also more favorable in a watertube boiler than in firetube boilers, because of the larger area of the outside heating surface which can be increased by the addition of extended surface in the form of spacer fins 26 (as shown in FIG. 3) to compensate for the low gas side heat transfer coefficient.

Accordingly, the boiler of this invention is very well adapted for use in cooling the hot high hydrocarbon content effluent gas emanating from the pyrolysis furnaces of ethylene plants.

An especially important feature of the invention resides in the location of the distributing and collecting headers. Since they are essentially outside the stream of hot gas passing through the boiler, any possible accumulation of solids in the distributing headers or in the steam pocket of the collecting headers, would not cause overheating.

With respect to the shape of the headers, it should be evident that they need not be cylindrical, thought that shape is no doubt best suited to fabrication. Also the curved shape of the common walls 20 facilitates uniform distribution of the junctions between the tubes with the headers, and enables each tube end to be squarely joined to the wall of the header.

Those skilled in the art will appreciate that the invention can be embodied in forms other than as herein disclosed for purposes of illustration.

The invention is defined by the following claims:

We claim:

1. In a watertube heat exchanger for abstracting heat energy from a hot gaseous medium by circulating a colder liquid medium through the tubes thereof, the improvement which eliminates the problems that result from the presence of tubesheets as in conventional firetubes heat exchangers, and which improvement comprises the combination of:

A. means defining a gas pass having a medial portion of substantially uniform cross section connecting opposite end portions of larger cross section;

B. means providing an inlet for the gas pass opening into one of said end portions;

C. means providing an outlet for the gas pass that exits from the other one of said end portions;

D. means defining a pair of spaced apart headers joined to each of said end portions of the gas pass, each header having a wall portion that is common to it and to its respective end portion of the gas pass; and E. the bank of tubes in the gas pass, all but the end portions of each tube in said bank being in said medial portion of the gas pass, the end portion of each of said tubes being in the larger cross section end portions of the gas pass and being bent laterally outwardly towards and having the extremities thereof joined to the adjacent one of said wall portions that are common to the headers and the gas pass, so that each tube communicates a header at one end of the gas pass with a header at the other end thereof, whereby the connection of the headers at one end of the gas pass with a steam drum by means of risers and the connection of the headers at the other end of the gas pass with the steam drum by means of downcomers, enables cooling liquid to circulate through the bank of tubes and abstract heat energy from the gaseous medium flowing through the gas pass.

2. The heat exchange of claim 1, wherein the gas pass is mounted with its axis vertical, and the headers into which liquid is conducted from the steam drum are at the lower end of the gas pass and the headers from which liquid-steam mixture flows to the steam drum are at the upper end of the gas pass.

3. The heat exchanger of claim 2, wherein the medial portion of the gas pass and the end portions thereof are cylindrical and coaxial, the latter being larger in diameter than the former and being joined thereto by intervening laterally disposed wall portions, and wherein each of said spaced apart headers projects into its respective end portion of the gas pass so as to dispose the wall portion of the header that is common to the gas pass in facing and substantially parallel relationship with the axis of the gas pass, and wherein the end portions of all of said tubes are substantially horizontally disposed.

4. The heat exchanger of claim 3, wherein each of said headers is cylindrical in cross section with the axis thereof parallel with the axis of the gas pass, so that the surfaces of the wall portions thereof that are common to the larger end portions of the gas pass and that face the axis of the gas pass are convexly curved, and wherein the junction of the end portions of the tubes with the headers are uniformly distributed over said convexly curved surfaces.

* * * * *